US009446284B2

(12) United States Patent
Sela

(10) Patent No.: US 9,446,284 B2
(45) Date of Patent: Sep. 20, 2016

(54) SQUAT EXERCISING

(71) Applicant: Kyle Michael Sela, Eagle, ID (US)

(72) Inventor: Kyle Michael Sela, Eagle, ID (US)

( * ) Notice: Subject to any disclaimer, the term of this patent is extended or adjusted under 35 U.S.C. 154(b) by 10 days.

(21) Appl. No.: 14/221,279

(22) Filed: Mar. 20, 2014

(65) Prior Publication Data

US 2015/0265872 A1 Sep. 24, 2015

(51) Int. Cl.

| | |
|---|---|
| ***A63B 21/02*** | (2006.01) |
| ***A63B 21/00*** | (2006.01) |
| ***A63B 23/035*** | (2006.01) |
| ***A63B 69/00*** | (2006.01) |
| ***A63B 21/04*** | (2006.01) |
| ***A63B 21/055*** | (2006.01) |
| ***A63B 23/04*** | (2006.01) |
| *A63B 71/00* | (2006.01) |
| *A63B 71/02* | (2006.01) |

(52) U.S. Cl.

CPC ..... *A63B 21/15* (2013.01); *A63B 21/00047* (2013.01); *A63B 21/0421* (2013.01); *A63B 21/0552* (2013.01); *A63B 23/0355* (2013.01); *A63B 23/0405* (2013.01); *A63B 69/0057* (2013.01); *A63B 21/00061* (2013.01); *A63B 21/00065* (2013.01); *A63B 2023/0411* (2013.01); *A63B 2071/0072* (2013.01); *A63B 2071/027* (2013.01); *A63B 2220/17* (2013.01); *A63B 2220/24* (2013.01)

(58) Field of Classification Search

CPC .... A63B 5/16; A63B 9/00; A63B 2009/006; A63B 17/00; A63B 17/02; A63B 17/04; A63B 21/00061; A63B 21/00065; A63B 21/0009; A63B 21/00094; A63B 21/00116; A63B 21/00123; A63B 21/00127; A63B 21/02; A63B 21/026; A63B 21/04; A63B 21/0407; A63B 21/0414; A63B 21/0421; A63B 21/0435; A63B 21/055; A63B 21/0552; A63B 21/068; A63B 21/08; A63B 21/1446; A63B 21/1457; A63B 21/1461; A63B 21/1465; A63B 21/1484; A63B 21/1492; A63B 21/1496; A63B 23/0222; A63B 23/035; A63B 23/03516; A63B 23/03525; A63B 23/0355; A63B 23/04; A63B 23/0405; A63B 23/0482; A63B 23/0488; A63B 23/0494; A63B 2023/0411; A63B 69/0057; A63B 69/0059; A63B 2069/0062; A63B 2208/02; A63B 2208/0204; A63B 2208/0223; A63B 2210/50; A63B 2210/52; A63B 2210/58; A63B 2225/09; A63B 2225/093; A63B 21/15; A63B 21/16

See application file for complete search history.

(56) References Cited

U.S. PATENT DOCUMENTS 1,067,767 A * 7/1913 Simonson ..... A47K 17/028 297/423.41
2,432,565 A * 12/1947 Ferguson ..... 2/24

(Continued)

*Primary Examiner* — Oren Ginsberg
*Assistant Examiner* — Gary D Urbiel Goldner
(74) *Attorney, Agent, or Firm* — Jeffrey Parry Intellectual Property Law Group PLLC; Jeffrey C. Parry

(57) ABSTRACT

The present disclosure comprises methods, apparatus, components, and techniques for performing a squat exercise. Embodiments of the present disclosure may assist the user to carry out a squat with proper form to reduce the risk of injury and increase effectiveness of the exercise. Embodiments of the present disclosure comprise a forward knee-arresting surface to restrict forward movement of the user's knees in order to keep the knees in line with the user's toes. Embodiments of the present disclosure further comprise lateral knee guides. A resistive force may be applied to the lateral knee guides to increase muscle exertion while carrying out the exercise.

9 Claims, 13 Drawing Sheets

(56) References Cited

U.S. PATENT DOCUMENTS

| | | | | |
|---|---|---|---|---|
| 3,608,896 | A * | 9/1971 | Brunet | 482/66 |
| 3,702,188 | A * | 11/1972 | Phillips at al. | 482/113 |
| 3,787,048 | A * | 1/1974 | Bock | 482/145 |
| 4,432,543 | A * | 2/1984 | Normandin | 482/131 |
| 4,603,690 | A * | 8/1986 | Skeen | 602/16 |
| 4,834,364 | A * | 5/1989 | Gongwer et al. | 482/131 |
| 4,925,185 | A * | 5/1990 | Gongwer et al. | 482/95 |
| 5,013,037 | A * | 5/1991 | Stermer | 482/122 |
| 5,052,375 | A * | 10/1991 | Stark et al. | 601/34 |
| 5,070,863 | A * | 12/1991 | McArthur et al. | 601/26 |
| 5,324,247 | A * | 6/1994 | Lepley | 482/134 |
| 5,383,831 | A * | 1/1995 | Drath | 482/101 |
| 5,527,248 | A * | 6/1996 | Crivello | 482/96 |
| 5,588,841 | A * | 12/1996 | Mechling | 434/255 |
| 5,593,374 | A * | 1/1997 | Gvoich | 482/123 |
| 5,860,492 | A * | 1/1999 | Talaska | 188/5 |
| 5,929,782 | A * | 7/1999 | Stark et al. | 340/870.01 |
| 6,004,245 | A * | 12/1999 | Boos | 482/93 |
| 6,148,448 | A * | 11/2000 | Urso | A47K 17/026 297/423.44 |
| 7,090,629 | B1 * | 8/2006 | Abbou | 482/148 |
| 7,410,450 | B1 * | 8/2008 | Paulding | 482/121 |
| 7,549,950 | B1 * | 6/2009 | Lundquist et al. | 482/101 |
| 7,559,881 | B1 * | 7/2009 | Roraff | 482/129 |
| 7,614,639 | B2 * | 11/2009 | Tholkes et al. | 280/638 |
| 8,083,655 | B2 * | 12/2011 | Hoebel | 482/129 |
| 8,597,165 | B1 * | 12/2013 | Antonucci | 482/131 |
| 8,955,871 | B2 * | 2/2015 | Takamoto et al. | 280/657 |
| 2004/0232739 | A1 * | 11/2004 | Wurzelbacher et al. | 297/4 |
| 2005/0130815 | A1 * | 6/2005 | Abdoli-Eramaki | 482/121 |
| 2005/0227826 | A1 * | 10/2005 | Oga | 482/92 |
| 2006/0097557 | A1 * | 5/2006 | Tholkes et al. | 297/330 |
| 2006/0247097 | A1 * | 11/2006 | La Voie et al. | 482/8 |
| 2007/0010772 | A1 * | 1/2007 | Ryan | 602/26 |
| 2007/0161480 | A1 * | 7/2007 | Trancart et al. | 482/907 |
| 2008/0199839 | A1 * | 8/2008 | Fugitt | 434/247 |
| 2009/0270231 | A1 * | 10/2009 | Hall et al. | 482/79 |
| 2009/0292229 | A1 * | 11/2009 | Nace | 602/16 |
| 2009/0318271 | A1 * | 12/2009 | Hobel | 482/66 |
| 2010/0274166 | A1 * | 10/2010 | Terrio | 602/23 |
| 2011/0071441 | A1 * | 3/2011 | Rodgers | 601/5 |
| 2011/0256983 | A1 * | 10/2011 | Malack et al. | 482/4 |
| 2011/0319238 | A1 * | 12/2011 | Sandvikmoen | 482/142 |
| 2012/0004079 | A1 * | 1/2012 | Hyacinth | 482/92 |
| 2012/0184412 | A1 * | 7/2012 | Glaner | 482/30 |
| 2012/0220432 | A1 * | 8/2012 | Henesey | 482/105 |
| 2012/0238418 | A1 * | 9/2012 | Reyes | 482/121 |
| 2013/0041300 | A1 * | 2/2013 | Nace | 602/16 |
| 2013/0127623 | A1 * | 5/2013 | Giveans | 340/573.7 |
| 2013/0184617 | A1 * | 7/2013 | Inaba | 601/33 |
| 2014/0057761 | A1 * | 2/2014 | Higgins | 482/94 |
| 2014/0066275 | A1 | 3/2014 | Miller | |
| 2014/0087928 | A1 * | 3/2014 | Luedeka | 482/130 |

* cited by examiner

SQUAT EXERCISING

BACKGROUND

1. Technical Field

The present disclosure relates generally to squat exercises. In particular, the present disclosure relates to apparatus and methods to assist a user in squatting with proper form and develop proper squatting pattern.

2. Description of Related Art

Squatting, in its variations and forms, is a movement that humans typically perform numerous times daily. However, many people may not perform squatting movements correctly. Incorrect squatting form can cause musculoskeletal injuries and pain. Such injuries or pain may be compounded as a result of people trying to incorrectly carry out squatting exercises as part of their workout or fitness regimen.

Squatting correctly can provide numerous benefits. For example, squatting exercises can prolong independence as a person ages, as such exercises can strengthen the lower back, hips, and thighs in a fashion that suits human biomechanics and increases functional strength.

In general, a squat may be carried out by a user starting in an upright position, with the user's heels shoulder width apart, then bending the knees and hips while moving the hips back to lower the user's upper body until reaching a squatting position. The user can then complete the squat by returning to the upright position. A common mistake people make while carrying out a squatting exercise is letting the knees move too far forward in the sagittal plane. In other words, from an observer at the user's side, it may be undesirable for the user's knees go more forward than an imaginary vertical line from the tips of the user's toes. Such a squatting motion is generally viewed as incorrect and may increase the risk of injury and reduce effectiveness of the squat exercise. In addition, it also may be preferable for a user to keep the knees pushed out over the toes in the frontal plane. In other words, from an observer in front of the user, it may be preferable for the user's knees to remain in line over the user's toes throughout the squat motion. In some cases, it may be beneficial for the knees to be pushed out even further than the toes to optimize knee, hip, and lower back position in deeper squat positions.

SUMMARY

In one embodiment, an apparatus for carrying out a squat exercise is disclosed. The apparatus has an anterior knee guide, a lateral knee guide, a base, and a vertical support for the anterior knee guide and the lateral knee guide. The vertical support is connected by a lateral hinge to the base. The lateral hinge can provide lateral rotation of the vertical support.

In another embodiment, a method of performing a squat is disclosed. The method includes placing the knees at or proximate to a forward knee-arresting surface and lowering the body to a squat position while maintaining the knees at the forward knee-arresting surface.

In another embodiment, an apparatus for carrying out a squat exercise is disclosed. The apparatus includes a forward knee-arresting surface anchored to a base.

The present disclosure will now be described more fully with reference to the accompanying drawings, which are intended to be read in conjunction with both this summary, the detailed description, and any preferred or particular embodiments specifically discussed or otherwise disclosed. This disclosure may, however, be embodied in many different forms and should not be construed as limited to the embodiments set forth herein; rather, these embodiments are provided by way of illustration only so that this disclosure will be thorough, and fully convey the full scope of the invention to those skilled in the art.

BRIEF DESCRIPTION OF THE DRAWINGS

Non-limiting and non-exhaustive embodiments of the present disclosure are described with reference to the following figures, wherein like reference numerals refer to like parts throughout the various views unless otherwise specified.

Figure 1:
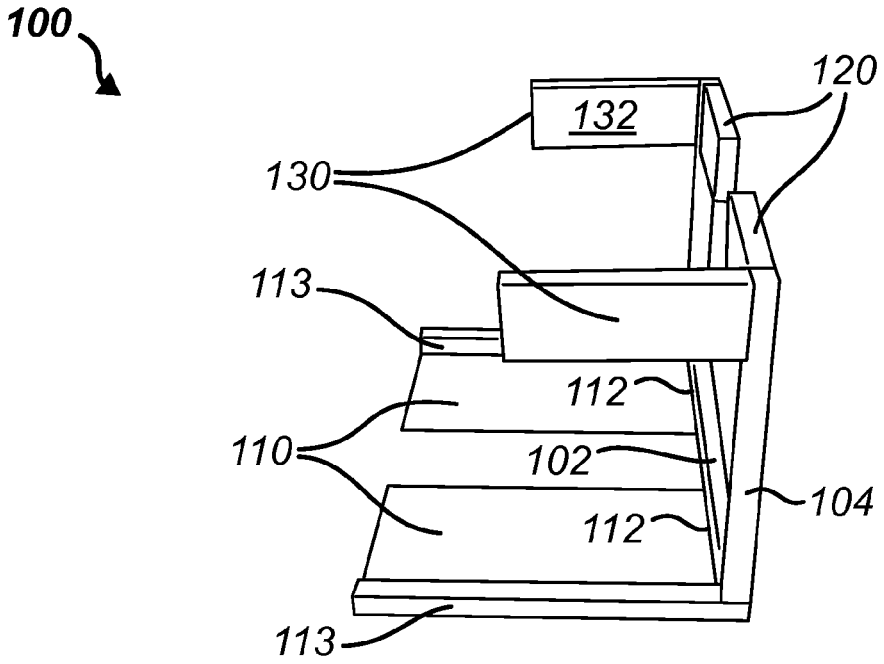
FIG. 1 depicts a side perspective view of a squat apparatus according to an embodiment of the present disclosure.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, reference is made to exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the spirit and scope of the present disclosure. The following detailed description is, therefore, not to be taken in a limiting sense.

Reference throughout this specification to "one embodiment," "an embodiment," "one example," or "an example" means that a particular feature, structure, or characteristic described in connection with the embodiment or example is included in at least one embodiment of the present disclosure. Thus, appearances of the phrases "in one embodiment," "in an embodiment," "one example," or "an example" in various places throughout this specification are not necessarily all referring to the same embodiment or example. Furthermore, the particular features, structures, or characteristics may be combined in any suitable combinations and/or sub-combinations in one or more embodiments or examples.

Embodiments of the present disclosure provide methods, apparatus, components, and/or techniques for performing a squat exercise with proper form. Referring to FIGS. 1-4, one embodiment of a squat apparatus 100 comprises stance plates 110, anterior knee guides 120, and lateral knee guides 130.

In embodiments, stance plates 110 comprise a base for squat apparatus 100, such than while a user is standing on stance plates 110, squat apparatus 100 may be held relatively stable by the user's weight. In embodiments, horizontal beam 102 holds stance plates 110 together at a stance width.

In one embodiment, each stance plate 110 is fixed to the underside of horizontal beam 102. As a result, horizontal beam 102 forms a toe stop 112 at the front of each stance plate 110. In other embodiments, toe stop 112 comprises an anterior rail adjacent to stance plates 110. Toe stops 112 may indicate where a user's feet should be placed for optimal use of squat apparatus 100. In another embodiment, toe stops 112 are formed from one or more vertical surfaces at the front of each stance plate 110. Other embodiments comprise other means for indicating preferred placement of a user's toes and/or feet. One embodiment comprises lateral rail 113 at the outside edge of each stance plate 110. Lateral rail 113 may additionally indicate where a user's feet should be placed for optimal use of squat apparatus 100.

In an embodiment, knee guide posts 104 position the anterior knee guides 120 and lateral knee guides 130 above each stance plate 110. In embodiments, each anterior guide 120 comprises surfaces 122, which are adapted to mitigate, minimize, or prevent forward movement of the user's knees. In the present disclosure, surfaces 122 may be referred to as a forward knee-arresting surface. In embodiments, anterior knee guides 120 comprise a rigid, substantially flat surface. In other embodiments, anterior guides 120 comprise a concave surface corresponding to the shape of a user's kneecap.

In embodiments, lateral knee guides 130 comprise surface 132, which is adapted to contact the lateral (outside) portion of a user's knee while a user is facing forward in a standing position on stance plates 110. In embodiments, surface 132 comprises a relatively flat form. In alternative embodiments, surface 132 conforms to a user's knee. In an embodiment, surfaces 122, 132 comprise steel or other rigid surface. In another embodiment, surfaces 122 and/or 132 are padded.

In an embodiment, horizontal beam 102 comprises telescoping members. In such an embodiment, an inner telescoping member of horizontal beam 102 can slide in or out from a corresponding outer telescoping member, thereby shortening or lengthening the horizontal beam 102. In this manner, the distance between stance plates 110 can be selectively customized to fit a user's physical stance. In embodiments, knee guides 120, 130 can swivel around a vertical axis on guide posts 104 and lock into place at a rotation position selected by a user. Such rotation position may be set according to the user's preferences and stance.

In embodiments, knee guide posts 104 comprise telescoping members. In such an embodiment, an inner telescoping member of each knee guide post 104 can slide in or out from a corresponding outer telescoping member, thereby shortening or lengthening the knee guide post 104. In this manner, the height of guides 120, 130 can be selectively customized to fit a user's height.

Figure 5:
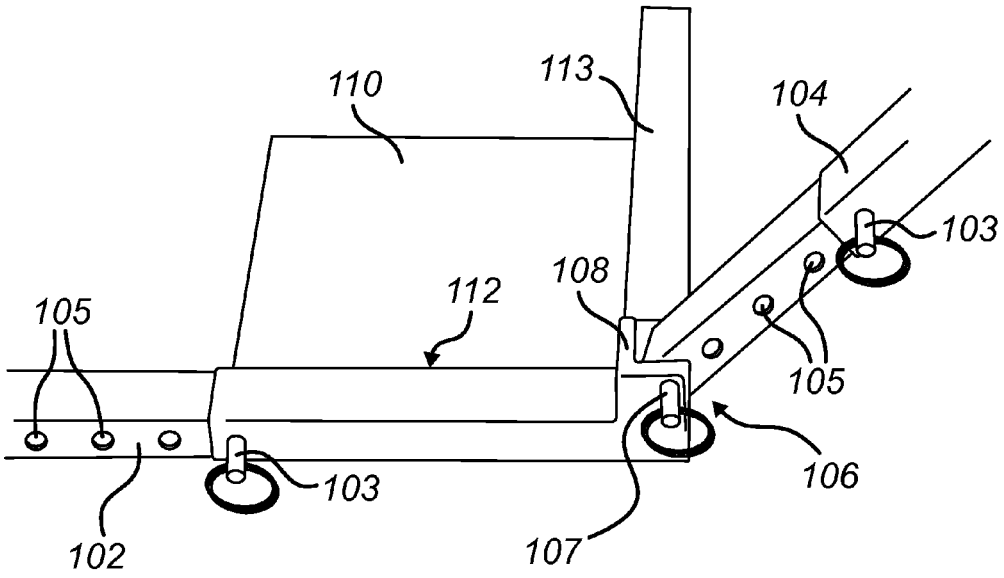
FIG. 5 depicts view of a hinge component of a squat apparatus according to an embodiment of the present disclosure.

Referring now to FIG. 5, embodiments of horizontal beams 102 and knee guide posts 104 comprise lock pins 103 inserted through aligned adjustment holes 105 in constituent telescoping members of horizontal beam 102 and/or knee guide posts 104 to lock telescoping members with each other and thereby set the width or the height of squat apparatus 100. In alternative embodiments, corresponding telescoping members are locked to each other by various means, including but not limited to spring lock retaining pins, clamps, screws, such as thumb screws, hex socket screws, and the like.

In embodiments, knee guide posts 104 are connected to horizontal beam 102 at a hinged joint 106 that allows lateral rotation of knee guide posts 104 while restricting forward or backward movement of knee guide posts 104 relative to stance plates 110. In other words, hinge joints 106 allow the knee guide posts 104 to hinge outward in the frontal plane. In one embodiment, hinged joint 106 comprises a pin 107 that is passed through corresponding holes in horizontal beam 102 and knee guide post 104, such that knee guide post 104 can rotate around pin 107. In an embodiment, pins 105, 107 connect to a retaining ring or like means to secure the pin 105, 107 in its corresponding hole.

In an embodiment, hinge joint 106 may allow knee guide posts 104 to rotate away from an initial exercise position toward a final exercise position. The initial exercise position can be defined by an angle of roughly 90 degrees between horizontal beam 102 and each knee guide post 104. The final exercise position can be defined by an angle of greater than 90 degrees between horizontal beam 102 and each knee guide post 104. Embodiments comprise an inner rotation stop 108 at each knee guide post 104 adapted to stop knee guide posts 104 from rotating inward past the initial exercise position. Referring now to FIG. 6C, in one example of a final exercise position, knee guide posts 104 have been swept outward from the initial exercise position, sweeping an angle of approximately 20 degrees from the initial position. In this example of the final exercise position, the knee guide posts 104 each form an angle of approximately 110 degrees with the horizontal beam 102. It is to be understood that in embodiments of the present disclosure, knee guide posts 104 can sweep outward to essentially any angle between 0 and roughly 90 degrees from the initial position according to the user's abilities and preferences.

Figure 2:
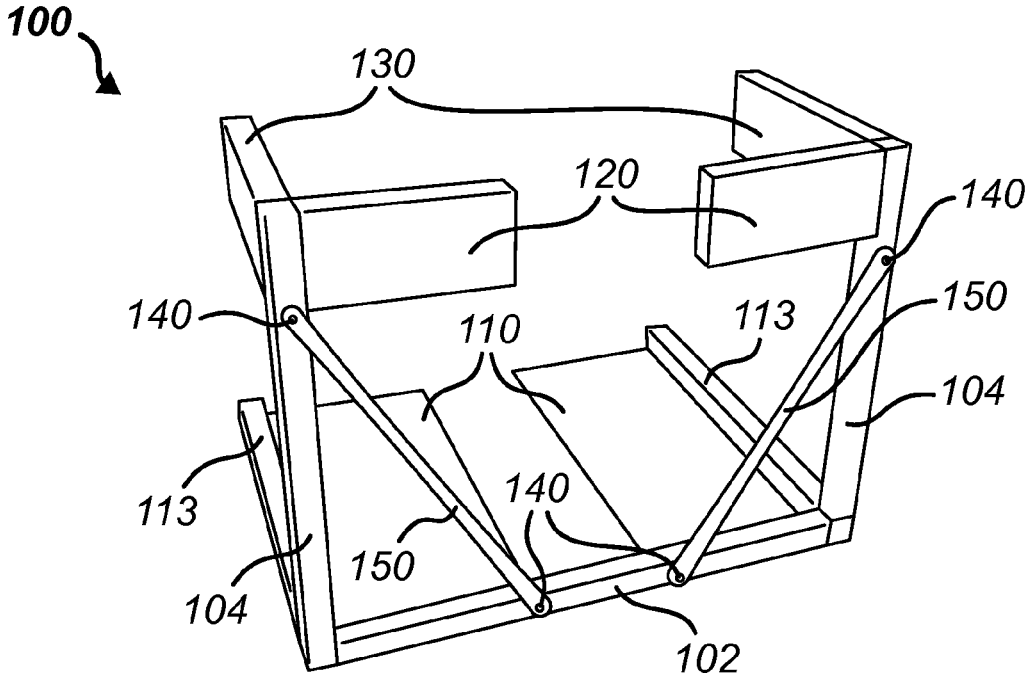
FIG. 2 depicts a front perspective view of a squat apparatus according to an embodiment of the present disclosure.
Figure 3:
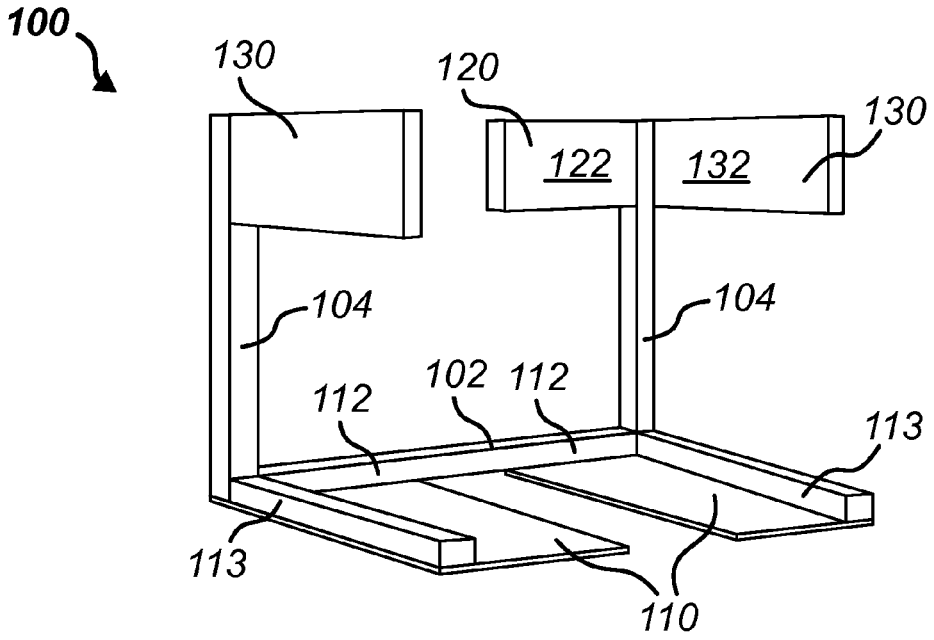
FIG. 3 depicts a rear perspective view of a squat apparatus according to an embodiment of the present disclosure.
Figure 4:
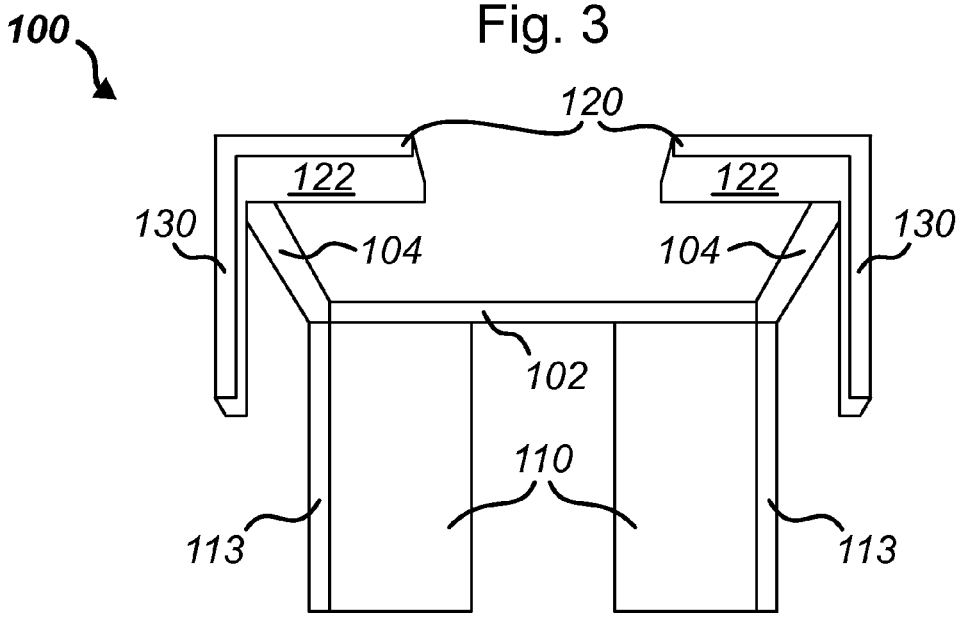
FIG. 4 depicts top view of a squat apparatus according to an embodiment of the present disclosure.
Figure 8:
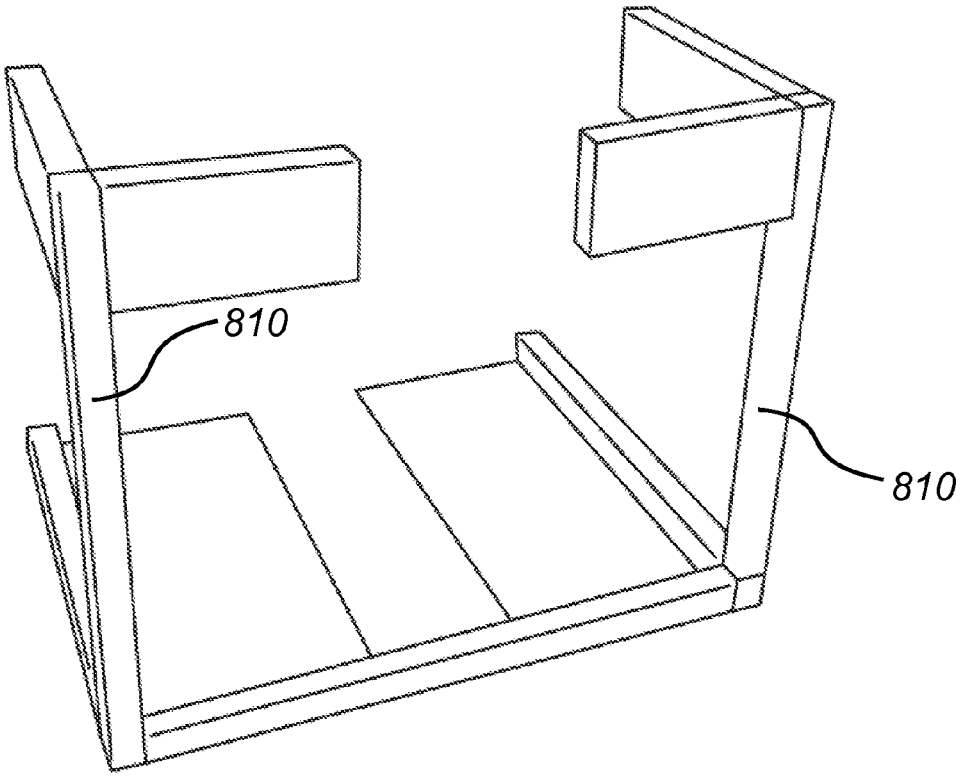
FIG. 8 depicts a front perspective view of a squat apparatus having flexible rods for providing lateral resistive forces according to an embodiment of the present disclosure.

In embodiments, a resistance mechanism can apply lateral resistive forces to lateral knee guides 130 to increase the physical resistance of the lateral rotation of knee guide posts 104 during exercise motions and to allow the user to progressively improve his or her ability to maintain correct knee position and increase hip strength and stability. Referring now to FIG. 2, in one embodiment, beam 102 and knee guide posts 104 further comprise pegs 140 protruding from the front of beams 102 and knee guide posts 104. In embodiments, pegs 140 comprise a rigid, durable protrusion. Resistance bands 150 may be placed on corresponding pairs of pegs 140 by placing ends of each band 150 over pegs 140. In this manner, bands 150 can apply a resistive force to lateral knee guides 130 via knee guide posts 104 to increase resistance of lateral rotation of knee guide posts 104. Elastic bands 150 of varying strength and/or thickness may be used with squat apparatus 100 to provide a selected exercise resistance. In other embodiments, lateral resistive force may be provided by other means. For example, in embodiments of the present disclosure, lateral resistive forces are provided by springs, flexible rods 810 (shown in FIG. 8), compressed air or other fluid resistance, weight and pulley, lever apparatus (including devices to lift the user's own body weight to provide lateral resistance), and other like means of providing physical resistance.

Embodiments of the present disclosure comprise a force gauge to measure and/or display how much force is exerted against the lateral knee guides 130 during exercises. In one example, a force gauge comprises a spring-based force gauge. In another example, a force gauge comprises a compressed air unit. In one embodiment, squat apparatus 100 comprises goniometer or other like device to measure and/or display the range of motion of guide posts 104 throughout a squat exercise on squat apparatus 100. In one embodiment, the goniometer measures the angle of one or both knee guide posts 104 relative to horizontal beam 102. In one embodiment, the goniometer displays an angle of zero at the initial exercise position and displays the angle of the knee guide posts 104 relative to the initial exercise position as the knee guide posts 104 are laterally rotated throughout a user's squatting motion.

Figure 11:
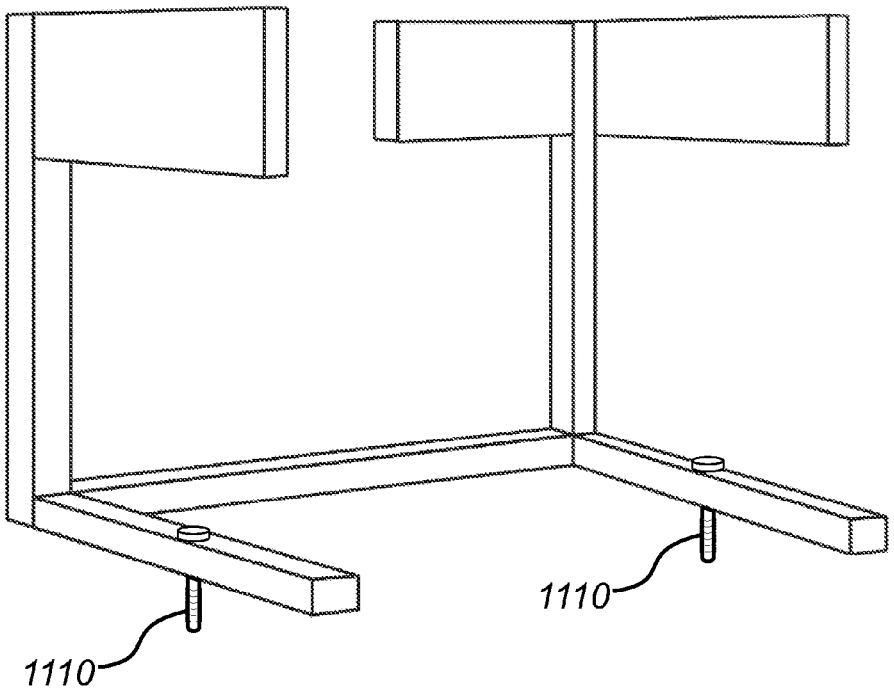
FIG. 11 depicts a squat apparatus base having a floor anchor according to an embodiment of the present disclosure.

In embodiments depicted, squat apparatus 100 comprises a piece of standalone, portable exercise equipment. However, alternative embodiments of the present disclosure comprise an apparatus that is integrated with other types of equipment. For example, a squat apparatus can be integrated with a squat rack or like cage, a Smith machine, a wall, and the like. In an embodiment, the base of squat apparatus is anchored directly or indirectly to a floor surface by a floor anchor 1110 (shown in FIG. 11). In another embodiment, knee guides 120 and/or 130 are secured to a box or like seating surface, on which box squats may be carried out and which comprises a base for squat apparatus. Embodiment of the present disclosure comprises a vertically-adjustable seating surface. In an embodiment, the seat is removable. In one embodiment, the seat comprises a counting device that counts contacts so the user can track repetitions and/or reset the counter to zero when desired.

Figure 10:
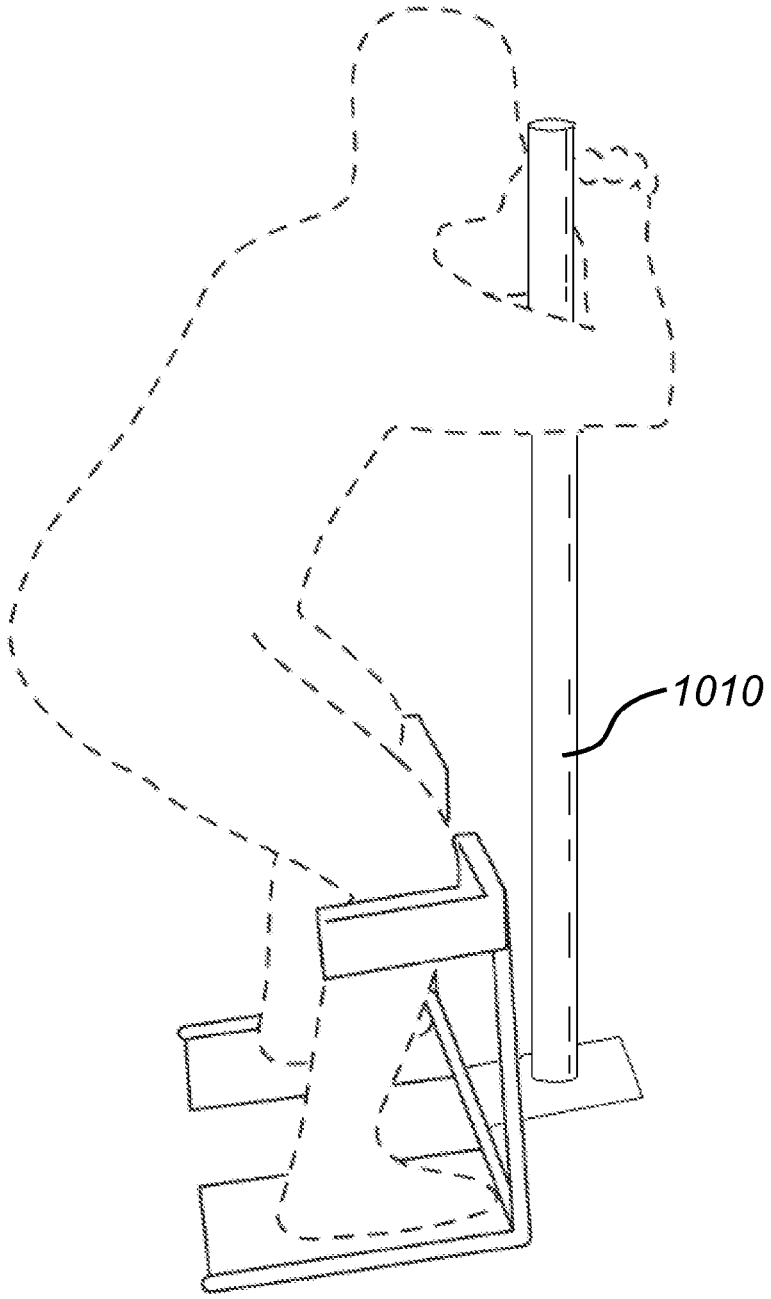
FIG. 10 depicts a squat apparatus having an upper body guide post according to an embodiment of the present disclosure.

Embodiments of the present disclosure comprise an anterior upper body guide post. The upper body guide post can be configured to act as a stop to keep the user's head and/or torso from extending forward past a set point and/or to cue the user to remain upright at their spine. In embodiments, the upper body guide post 1010 (shown in FIG. 10) may be gripped by the user for support, to check balance, and/or aid the legs when fatigued.

In operation, squat apparatus 100 can assist a user to complete a squat exercise with proper form. In particular, squat apparatus 100 may stop a user from extending the knees forward past the tips of the user's toes during a squat. Additionally, squat apparatus can guide a user to maintain the knees over the user's toes during a squat. According to some embodiments of the present disclosure, squat apparatus 100 may increase the resistance of performing a squat exercise. To overcome such resistance, a user can exert greater amounts of force produced by the user's hips. As a result, the increased resistance can help the user increase strength and stability while squatting. A user may select an exercise resistance level by putting on squat apparatus 100 one or more bands 150 having desired elastic resistance properties, or by otherwise selecting a resistance level.

In embodiments, a user can hold a barbell, dumbbells, or other weights to increase muscle exertion during squatting. Weights may be held in various positions. For example, a barbell may be held on the user's shoulders, across the user's chest, overhead and in other positions for squat exercises. In other embodiments, other types of resistance apparatus may be used to resist a user's upward movement. For example, elastic bands may be anchored to squat apparatus 100 or other anchor and secured by the user. As the user stands upright during a squat, the elastic bands stretch, thereby applying an opposing resistance to the movement. In other embodiments, flexible rods may be used to provide resistance to upward squatting movement. In other embodiments, additional types of resistance applications, or combinations of various types of resistance applications may be utilized. In embodiments, a box, chair, or other seating surface may be placed behind the user's feet to carry out a box squat. A user can progressively use lower surfaces to continually challenge and improve the user's squat ability.

Prior to performing a squat exercise, the user may set the width of stance plates 110 to match the user's shoulder width and/or allow for varying degrees of toe out position (given that hip angles vary for different users). In one embodiment, the user can set the width by adjusting and locking telescoping members of horizontal beam 102 so that while the user is standing on the stance plates 110 with the toes contacting the toe stop 112, the lateral side of each foot contacts the lateral rail 113.

The width of stance plates 110 may be optimized for the anatomy of some users that exhibit a degree of toe-out in their stance. Accordingly, the knee guides 120, 130 can be set according to the user's foot position so that the anterior and lateral knee guides 120, 130 will guide the user's knees into proper position. In embodiments, this setting may be achieved by rotation of the knee guides 120, 130. The adjustable side rails 113 can be set into place to match the user's selected amount of toe out stance. The height of knee guide posts 104 can be set and locked so that guides 120, 130 are level with the user's knees.

Figure 6A:
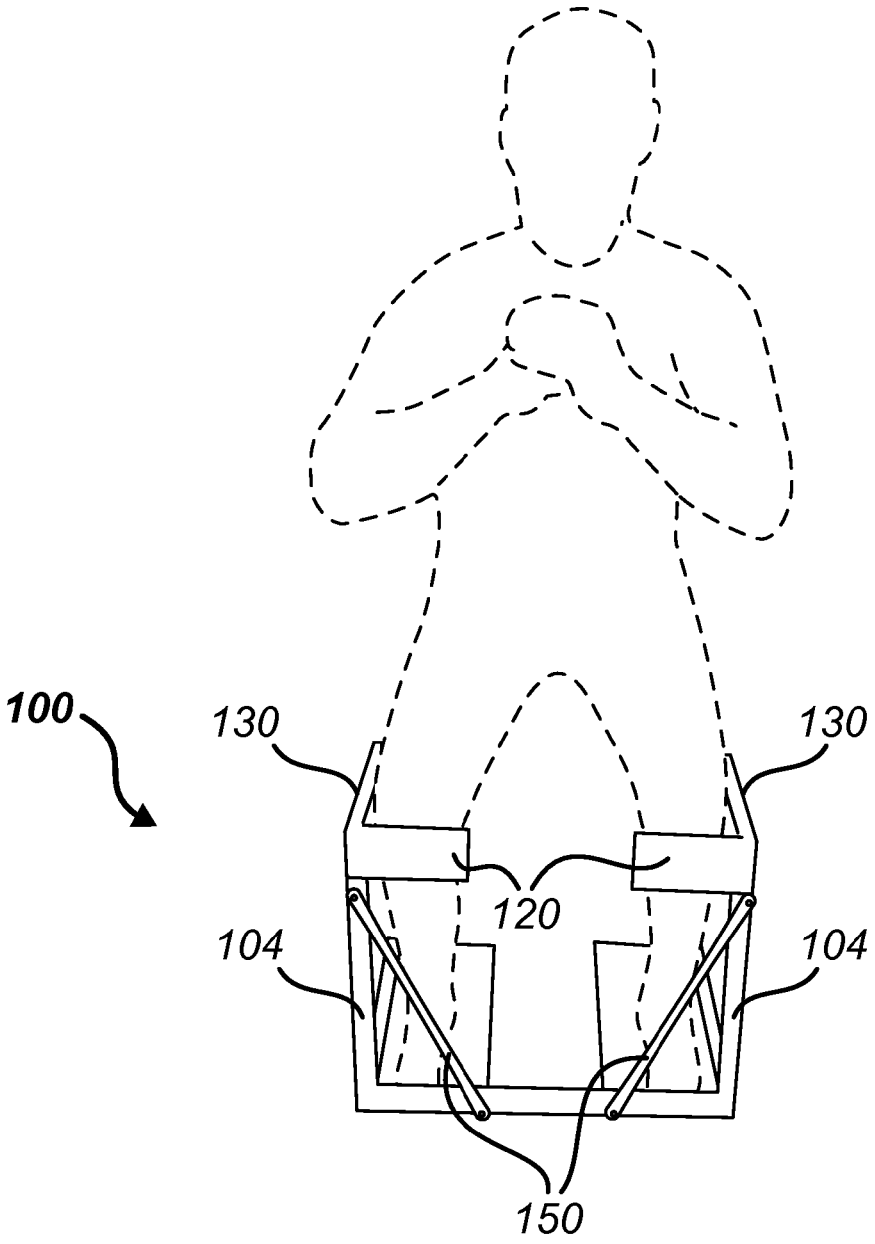
FIGS. 6A-6C depict a front view of a user carrying out a squat motion according to embodiments of the present disclosure.
Figure 7A:
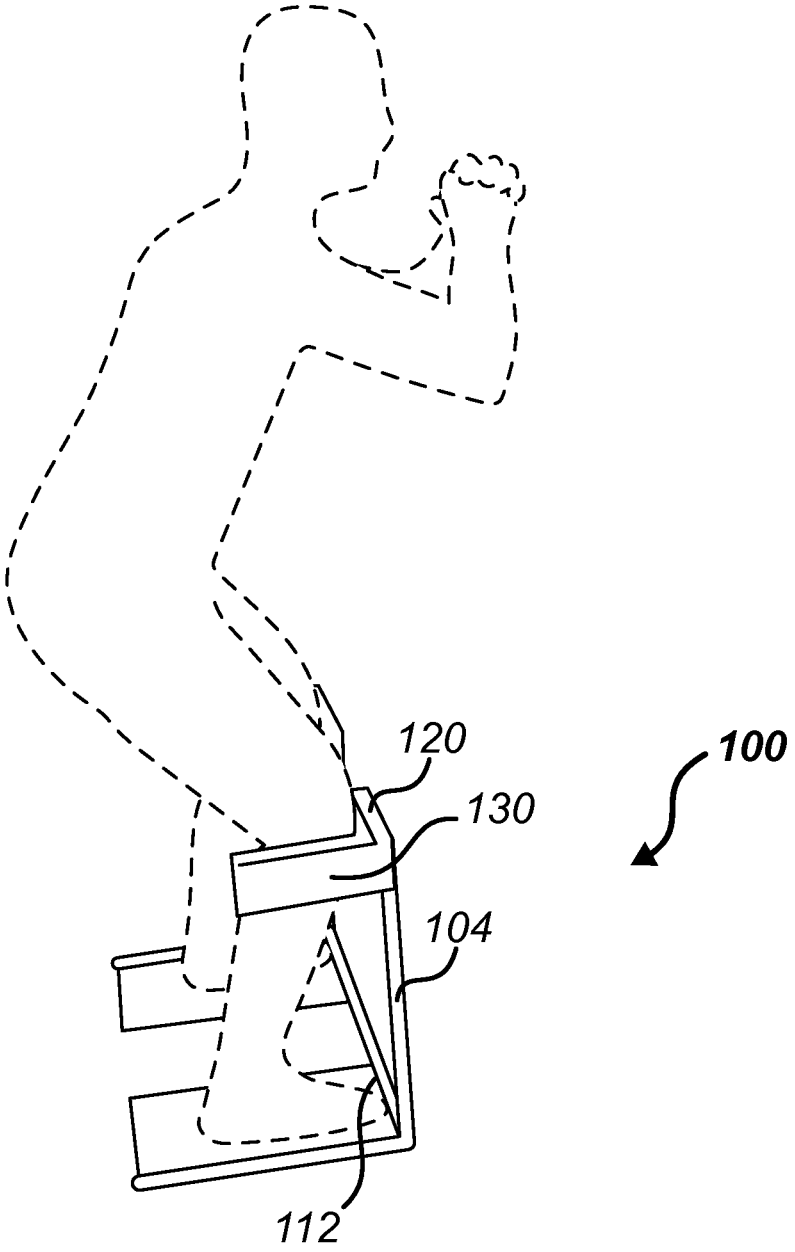
FIGS. 7A-7C depict a side view of a user carrying out a squat motion according to embodiments of the present disclosure.

Referring now to FIGS. 6A and 7A, a user prepares to carry out a squat exercise on squat apparatus 100 by standing on stance plates 110 and positioning both feet as far forward as possible until the user's toes abut toe stops 112. While thus positioned, the user's knees may be proximate to and/or abutted against the anterior knee guides 120 and/or lateral knee guides 130. In one embodiment, the term "proximate" means within 0 to 0.5 inches. In another embodiment, the term "proximate" means within 0 to 1 inch. In another embodiment, the term "proximate" means within 0 to 2 inches. In another embodiment, the term "proximate" means within 0 to 3 inches.

Figure 6B:
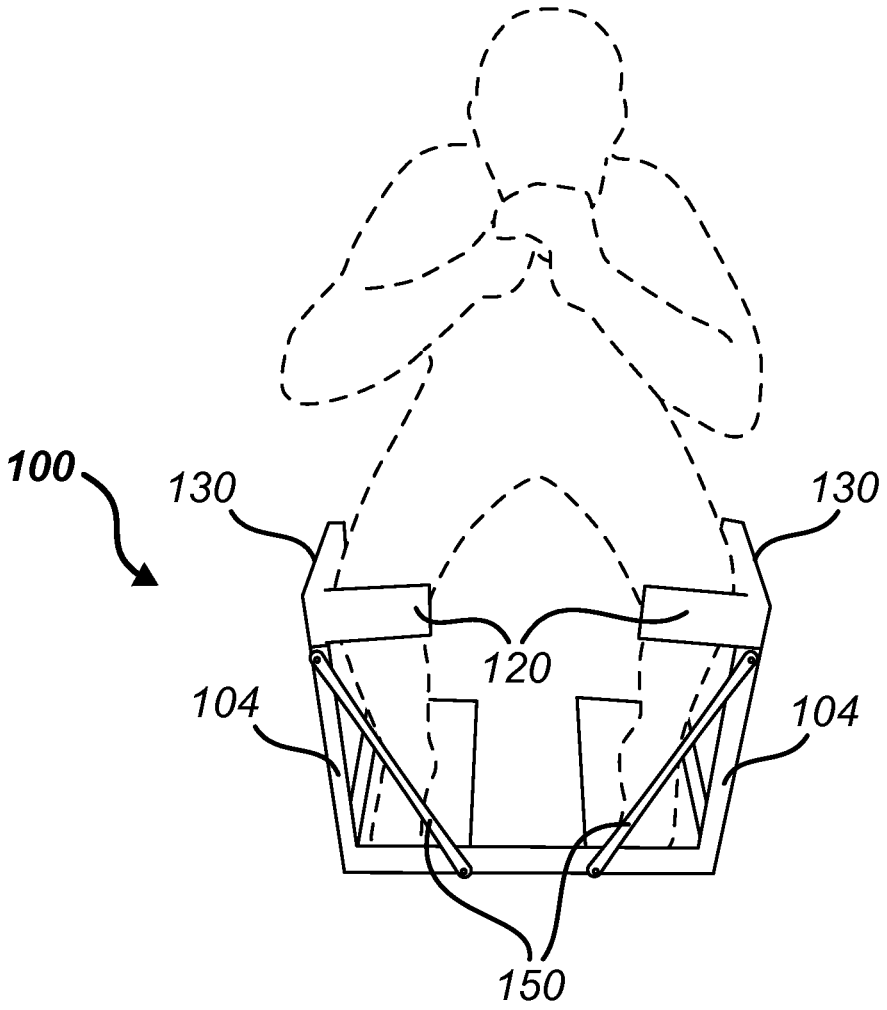
Figure 6C:
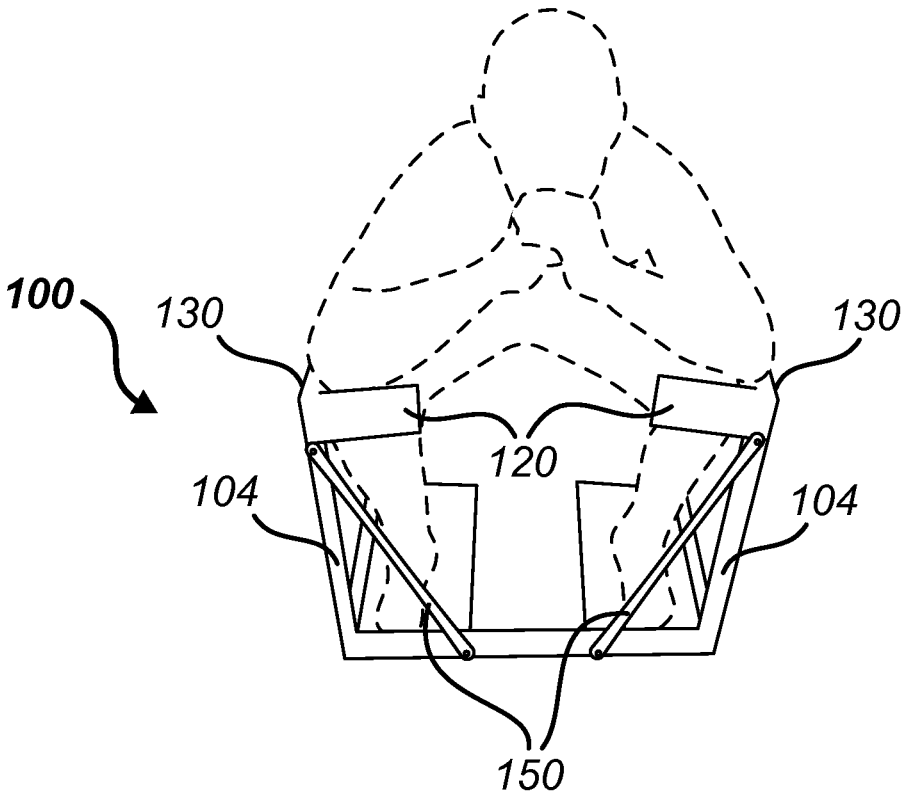
Figure 7B:
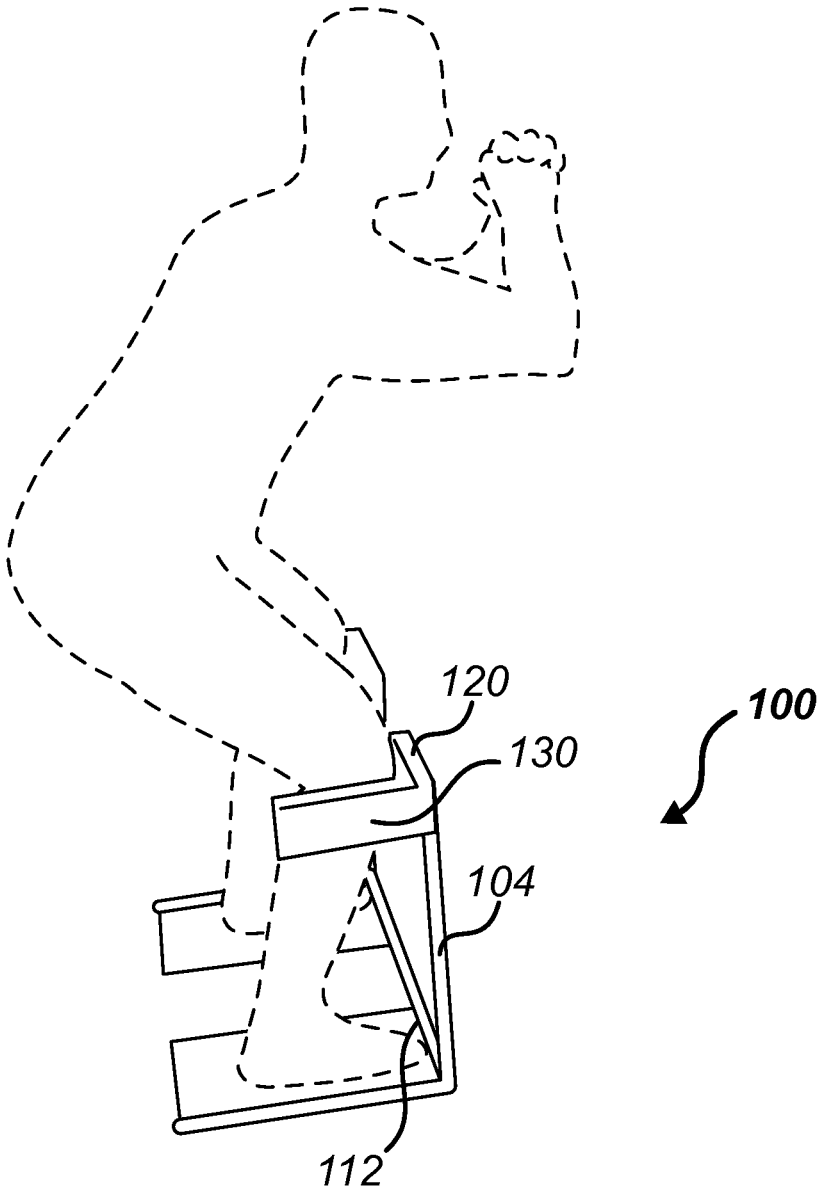

Referring now to FIGS. 6B and 7B, the user may then proceed to squat by bending the hips then knees while moving the hips back and down to lower the user's upper body. As the user bends the knees, a common tendency may be to push the knees forward. However, anterior knee plates 120 can restrict forward movement of the user's knees throughout the squatting exercise motion, thereby assisting the user to maintain proper squatting form. Lateral knee guide 130 resists outward movement of the user's knees according to the resistance selected. In one embodiment, such outward resistance may be applied once the user's knee is in a minimally-acceptable outward position. Thus, a user may increase muscle exertion and thereby increase strength and stability through repeated exercise.

Figure 7C:
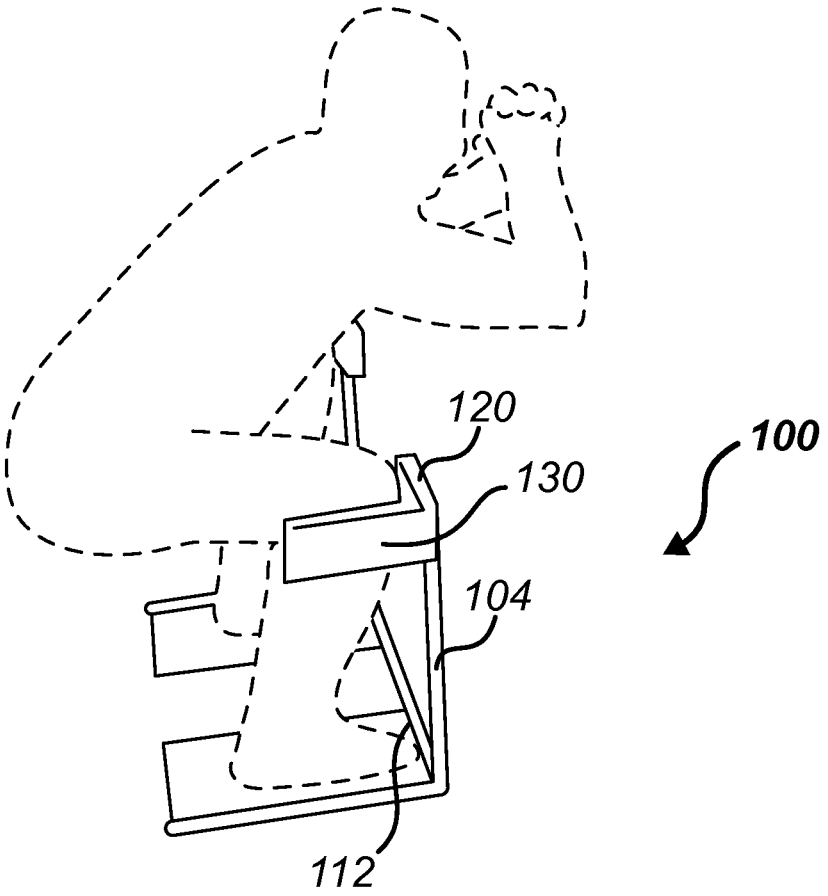

As depicted in FIGS. 6C and 7C, the user completes the downward squatting motion by lowering his or her torso as low as desired. It is to be understood that the user may carry out a squat exercise as deep or as shallow as desired using squat apparatus of the present disclosure.

After reaching the lowest point of the squat, the user can then complete the squat exercise by returning to the upright position. Throughout the movement, anterior guides 120 can restrict forward movement of the user's knees. In an embodiment, the user may make and sustain contact with the lateral knee guides 130 while attempting to avoid contacting the anterior knee guides 120 throughout the squat motion. The anterior knee guides 120 can thus reduce unwanted excessive sagittal plane knee movement while lateral knee guides 130 can facilitate optimal frontal plane knee position and hip movement. According to embodiments of the present disclosure, lateral knee guides 130 may help a user maintain proper form while carrying out squat exercises. For example, as a person squats, if the knees are not contacting lateral knee guides 130, the person may be internally rotating the hips, which may lead to medial collapse of the user's knees. Such form may cause knee pain and/or injury. Accordingly, a user may improve squat form by maintaining contact with lateral knee guides 130 throughout the entire squat exercise and thus minimize or prevent knee pain and injury.

Figure 9:
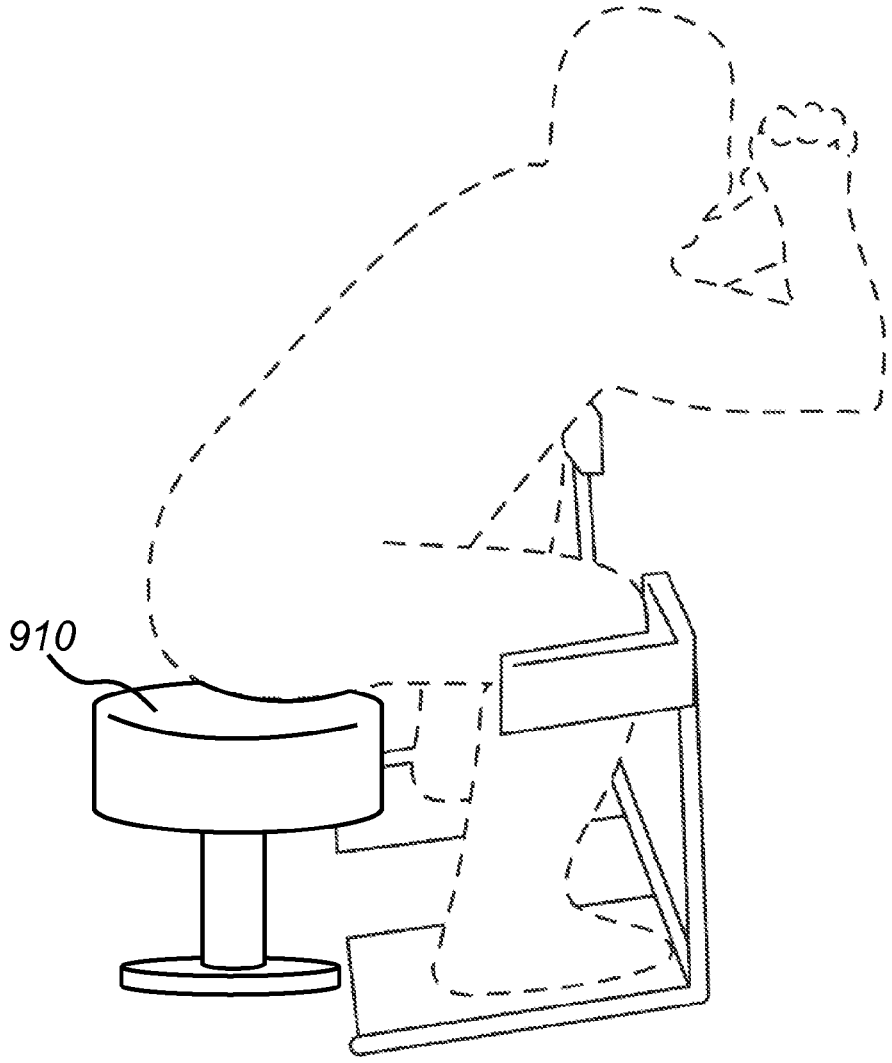
FIG. 9 depicts a squat apparatus having a seat according to an embodiment of the present disclosure.

In embodiments, an adjustable seat 910 (shown in FIG. 9) can be used to track the user's squat depth development. Some users may find that squatting correctly is difficult and that one should develop increased muscular strength and motor control in order to perform a squat to full depth. The adjustable seat 910 can give users a guide and goal to measure how low they are getting in their squat exercises. For example, a user can set the seat 910 at a selected height and carry out one or more squats, contacting the seat 910 at the lowest portion of the squat. When the user is ready to progress to a lower squat, the seat 910 may then be moved to a lower position to carry out deeper squats. In embodiments, the seat 910 can provide a place to rest. In embodiments, the seat 910 can be removed to let a user carry out squats at full depth. The seat 910 may also be equipped with a counting device so the user can track repetitions. Such a counting device may increment a counter each time the user contacts the seating surface.

Although the present disclosure is described in terms of certain preferred embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the spirit and scope of the present disclosure.

What is claimed is:

1. An apparatus for carrying out a squat exercise comprising:

a base comprising a substantially horizontal base surface and a toe stop indicator;

an anterior knee guide configured to block an anterior surface of a left knee of a user and an anterior surface of a right knee of the user from moving more forward than the toe stop indicator as the user carries out the squat exercise;

two lateral knee guides configured to respectively contact a lateral surface of the left knee of the user and a lateral surface of the right knee of the user as the user carries out the squat exercise;

two vertical supports, each vertical support being coupled to the corresponding lateral knee guide configured for each respective knee of the user;

two lateral hinges respectively connecting each vertical support to the base, each lateral hinge being laterally rotatable about an axis perpendicular to the respective vertical support, wherein each lateral hinge is adapted to provide lateral rotation of the respective vertical support away from an initial exercise position to a final exercise position, wherein the initial exercise position is defined by a center-facing angle of substantially 90 degrees between the horizontal surface and the respective vertical support, and wherein the final exercise position is defined by a center-facing angle of greater than 90 degrees between the horizontal surface and the respective vertical support; and two rotation stops configured to prevent inward rotation of each respective vertical support past the initial exercise position to a center-facing angle less than 90 degrees between the horizontal surface and each respective vertical support.

2. The apparatus of claim 1, wherein the anterior knee guide comprises two anterior knee guides configured to respectively block the anterior surface of the left knee of the user and the anterior surface of the right knee of the user from moving more forward than the toe stop indicator.

3. The apparatus of claim 1, further comprising a resistance mechanism adapted to apply a resistive force to the lateral rotation of the vertical supports.

4. The apparatus of claim 3, wherein the resistance mechanism comprises an elastic band.

5. The apparatus of claim 3, wherein the resistance mechanism comprises a flexible rod.

6. The apparatus of claim 1, wherein the base further comprises two horizontal stance plates, whereby selectively adjusting a distance between the two lateral hinges correspondingly adjusts the distance between the two horizontal stance plates.

7. An apparatus for carrying out a squat exercise comprising: an anterior knee guide configured to be proximate to and in front of an anterior surface of a left knee of a user and an anterior surface of a right knee of the user as the user carries out the squat exercise; a toe placement indicator in vertical alignment with the anterior knee guide; two lateral knee guides configured to be in respective vertical alignment with a lateral surface of a left foot of the user and a lateral surface of a right foot of the user; and a resistance mechanism adapted to apply a resistive force to a lateral movement of each lateral knee guide, wherein the resistance mechanism comprises an elastic band.

8. The apparatus of claim 7, further comprising a base that comprises a stance plate.

9. The apparatus of claim 8, wherein the base comprises a floor anchor.

* * * * *